United States Patent [19]

Horn

[11] Patent Number: 4,852,141

[45] Date of Patent: Jul. 25, 1989

[54] PORTABLE X-RAY COLLIMATOR AND SCATTER SHIELD

[75] Inventor: Michael Horn, South Setauket, N.Y.

[73] Assignee: Grumman Aerospace Corporation, Bethpage, N.Y.

[21] Appl. No.: 80,809

[22] Filed: Aug. 3, 1987

[51] Int. Cl.[4] ..... G21K 1/02

[52] U.S. Cl. ..... 378/147; 378/145; 378/203; 250/515.1

[58] Field of Search ..... 378/147, 145, 203; 250/515.1

[56] References Cited

U.S. PATENT DOCUMENTS

| | | |
|---|---|---|
| 965,533 | 7/1910 | Myers . |
| 1,156,906 | 10/1915 | Kelly . |
| 2,135,019 | 7/1936 | Struck . |
| 2,137,122 | 3/1935 | Humphreys . |
| 2,794,128 | 10/1954 | Shasky . |
| 3,113,089 | 12/1963 | Nagey et al. . |
| 3,161,776 | 12/1964 | Moore . |
| 3,649,426 | 3/1972 | Gates, Jr. . |
| 3,737,661 | 6/1973 | Applegate . |
| 4,127,776 | 11/1978 | Pickel ..... 378/205 |
| 4,286,169 | 8/1981 | Rossem . |

FOREIGN PATENT DOCUMENTS

| | | |
|---|---|---|
| 1073687 | 2/1959 | Fed. Rep. of Germany . |
| 1286503 | 7/1962 | France . |
| 1734225 | 1/1965 | France . |

*Primary Examiner*—Carolyn E. Fields
*Assistant Examiner*—David P. Porta
*Attorney, Agent, or Firm*—Stetina and Brunda

[57] ABSTRACT

A shielding apparatus for use in conjunction with an X-ray generator is disclosed. The apparatus comprises a shielding cone extending from the X-ray generator toward the object to be X-rayed, said cone comprising an upper cone portion detachably connected to the X-ray generator, a lower cone portion forming the base of the cone and a plurality of panels detachably connected to and extending between the upper and lower cone support portions. Additional shielding components are provided about the X-ray generator and secured to the shielded cone to further reduce the emission of stray X-rays.

20 Claims, 3 Drawing Sheets

PRIOR ART

PORTABLE X-RAY COLLIMATOR AND SCATTER SHIELD

BACKGROUND OF THE INVENTION

1. Field of the Invention

This invention relates in general to a shielding device for a source of radiation, and more particularly, device to a modular and portable X-ray collimator and shielding 2. Description of the Prior Art The relevant field of the present invention is best illustrated by the following references:

| | |
|---|---|
| Rossem | 4,286,169 |
| Applegate | 3,737,661 |
| Gates | 3,649,426 |
| Moore | 3,161,776 |
| Nagey | 3,113,089 |
| Shasky | 2,794,128 |
| Humphreys | 2,137,122 |
| Struck | 2,135,019 |
| Kelly | 1,156,906 |
| Myers | 965,533 |
| French application | 1,374,225 |
| French application | 1,286,503 |
| German application | 1,073,687 |

X-rays are short wave electronic magnetic vibrations which can penetrate solid manner. They are produced when, in the vacuum, electrons are released, accelerated and then abruptly retarded. Such rays are detrimental to the living cells and tissues of human beings.

Attempts have been continually made to shield the harmful radiations. The maximum allowed radiation for health protection standards for non-occupational personnel is approximately two milli roentgens/hour. The average critical radiation distance for a conventional X-ray generator during its maximum output is 18.29 meters (60 ft.) from the point of exposure. Contemporary X-ray shielding apparatus are limited in their ability to reduce the radiation field to safe levels within the general proximity of the X-ray source, i.e. within a radius of 3.05 meters (10 ft.) from the source of radiation.

Known prior shielding devices are limited in their ability to eliminate radiation, especially when the object to be X-rayed is large and relatively flat, such as an aircraft structure. Moreover, none of the prior known shielding devices combine the shielding capability with the portability and modular construction provided by the present invention.

The Applegate patent, for instance, describes a shielded adaptor attachable to a portable X-ray device having a collimator and a container rotationally and pivotally mounted thereon. The container has an upper and an overlapping bottom part between which portion of the object to be X-rayed can be completely enclosed.

The French patent No. 1,374,225 teaches the use of a shield in combination with a clenching joint surrounding the object to be X-rayed.

Neither reference discloses a portable, light-weight X-ray device that effectively shields the emitted radiation and can be used to X-ray flat surfaces of large structures.

At present, the primary absorption shielding material used is lead (Pb), which is well characterized by extreme high density and weight. Thus, the present shielding devices are exceedingly heavy, which limits the deportability, assembly, disassembly, storage and transportation of said structures. Such limitations are reflected in the high costs of operation and maintenance of the present shielding devices.

Therefore, there is a long felt need for a portable, lightweight, collimator and scatter shield device which addresses and resolves the above problems.

SUMMARY OF THE INVENTION

It is therefore, the object of the present invention to provide for a new and improved collimator and shielding apparatus to efficiently shield substantially all forms of limited radiations.

It is a further object of the present invention to provide for a portable collimator and shielding apparatus which could be used in combination with large or flat structures.

It is yet another object of the present invention to provide for an apparatus which is inexpensive and easily assembled and disassembled.

The present invention comprises a source of radiation, a modular collimator engaging the source of radiation, a shielding shroud for the source of radiation, a shielding cover for the port of the radiation source, and holding fixture supporting the collimator and shielding apparatus.

The present invention presents several advantages over the existing shielding devices. The present collimator and shielding apparatus could easily be adapted for use in conjunction with commercially available X-ray generators, thus allowing working personnel as close as 3.05 meters (10 ft.) to the generator during its maximum output exposure, e.g. 2 mr/hr.

By providing for a modular construction of the present apparatus, the weight of the lead shielding required to attenuate the limited radiation is reduced thus facilitating the assembly storage and transportation of the apparatus.

With such a modular construction, a specialized technician is no longer required to perform the necessary maintenance. Technicians with lower skill levels can readily assemble and disassemble the apparatus. The invention therefore results in an increase in overall productivity in that specialized technicians may be more efficiently utilized to perform tasks than the maintenance of the shielding apparatus. The simplicity of the design of the present apparatus thus reduces the operating costs, due to the substitution of specialized technicians with cheaper labor.

BRIEF DESCRIPTION OF THE DRAWINGS

The above-mentioned and other object and features of this invention and the manner of obtaining them will become more apparent and the invention itself will be best understood by reference of the following description of the embodiment of the invention taken in conjunction with the accompanying drawings, wherein.

DETAILED DESCRIPTION OF THE PREFERRED EMBODIMENT

Figure 1:
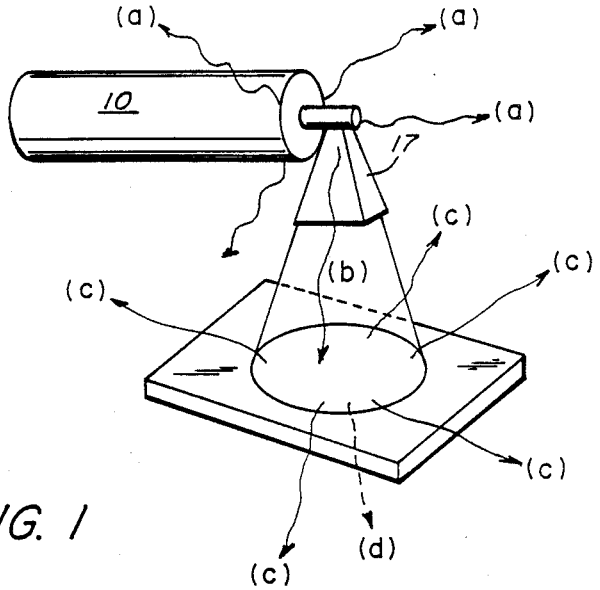
FIG. 1, is a perspective view of a X-ray generator with a prior art shielding apparatus illustrating various types of radiation leaks that may be substantially eliminated in the present invention.

Referring now to the drawings, and in particular to FIG. 1, there is shown a contemporary X-ray generator 10 having a shield 17 operative to shield a portion of the shielded radiation emitted from generator 10. This figure also illustrates the undesirable forms of radiation that are not eliminated with existing shielding devices, and which are sought to be substantially eliminated by the present invention. Such forms of radiation include (a) leakage, (b) primary, (c) scatter, and (d) transmitted.

Figure 2:
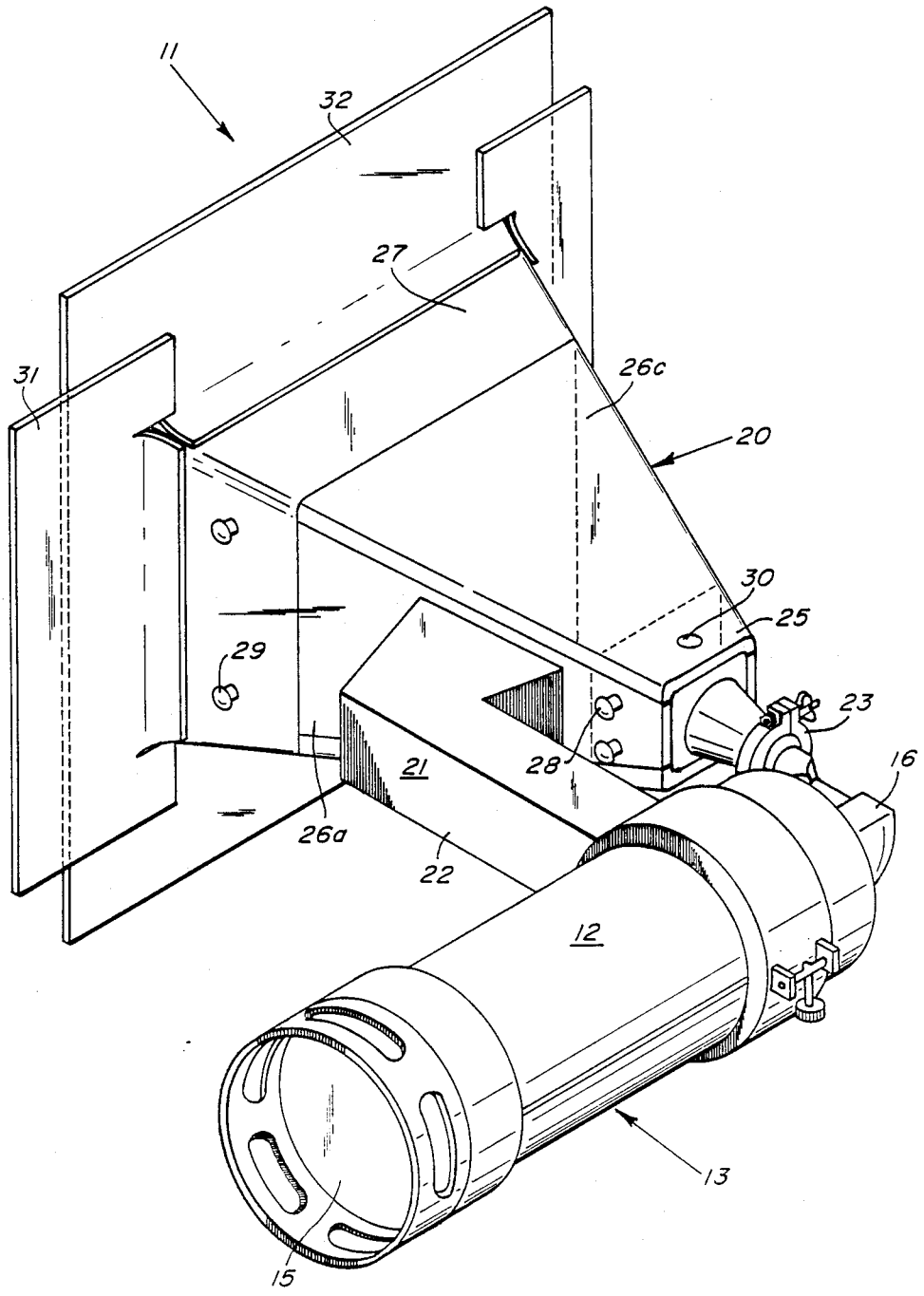
FIG. 2, is a perspective view of the present invention showing the details thereof.

In general, the device illustrated at FIG. 2 includes an X-ray generator, a generally trapezoidal shaped shroud connected to the X-ray generator, a support fixture connecting the X-ray generator to the shroud and permitting relative movement therebetween, and a plurality of flaps secured to the shroud opposite the X-ray generator. It is to be understood that the teachings of the present invention may be used to construct a corresponding device or to modify contemporary X-ray devices for enhanced operation and convenience, as described below. The preferred embodiment of the present collimator and scatter shield is illustrated in FIG. 2, comprising an X-ray generator tank 13 and a shroud 12, which totally and detachably fits about and is secured to the X-ray generator tank 13. Generator tank 13 may be one of a variety of commercially available devices. As shown at FIGS. 2–5, the shroud 12, is carefully mounted under the cooling lines 33. Once engaged, the shroud 12, may be left on the generator 13, and stored therewith. The shroud 12, is preferably formed as a cylindrically shaped sheet of vinyl covered lead 0.32 cm. ($\frac{1}{8}$") thick. A cap 15 also preferably formed of vinyl covered lead is disposed at a bottom portion of the X-ray generator 13.

The shroud 12, is installed by first attaching the shroud, to the generator tank 13, under the cooling lines 33. The electrical connector (not shown) is then removed from the back of the generator tank 13. Next, a rubber installation cap (not shown) is removed from the wire leads in back of the generator tank 13. The wire leads (not shown) are then disconnected from the lead screws (not shown). The lead disc 15, is then installed over the back of the generator tank 13. Finally, the electrical leads, connector and rubber installation cap are reconnected.

Figure 5:
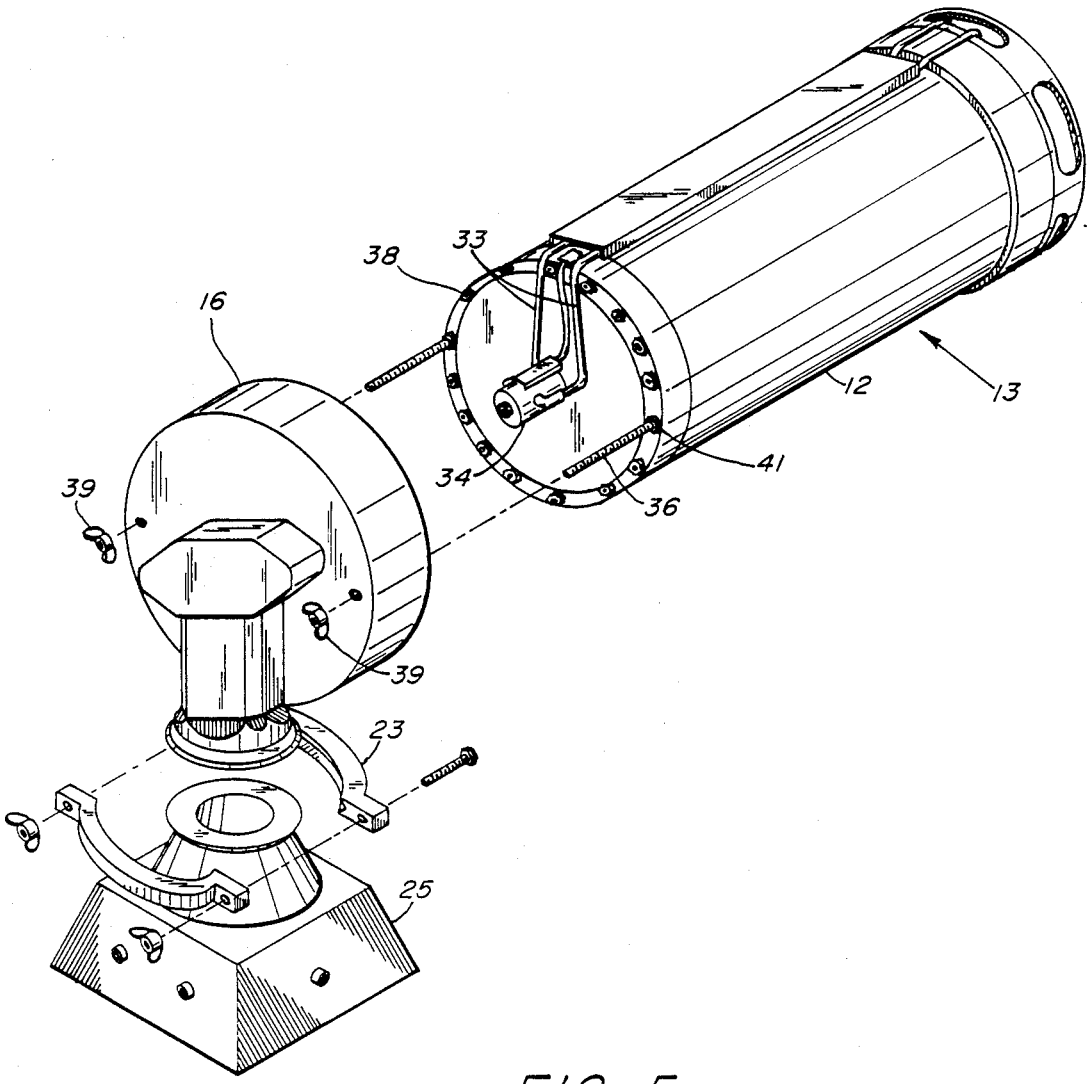
FIG. 5, is a cross section of the collimator cone along the line 4—4 of FIG. 3 showing the panels and interlock condition.

The present apparatus 11, further comprises a tubehead shield 16, shown in more detail at FIG. 5, which covers the upper portion, i.e. first 10.16 cm (4"), of the generator tank 13. The tubehead shield 16, also covers the entire tubehead and port 34. The tubehead shield 16, is preferably made of aluminum lined, with lead, and is adapted to engage upper portion 25 of collimator cone 20, described in more detail below.

The tubehead shield 16 is tightly affixed to the generator tank 13 by first removing two bolts (not shown) from the tubehead dome 38 and by replacing these bolts with two screws 36. The ends of the screws 36 are then secured to the tubehead by means of retainer nuts 41. The body and the ends of the screws project outwardly from the tubehead dome, and slide through two holes in the tubehead shield 16. Two winged nuts 39 are then fastened to the screws 36 to secure the tight connection between the tubehead 16, and the generator 13.

Figure 3:
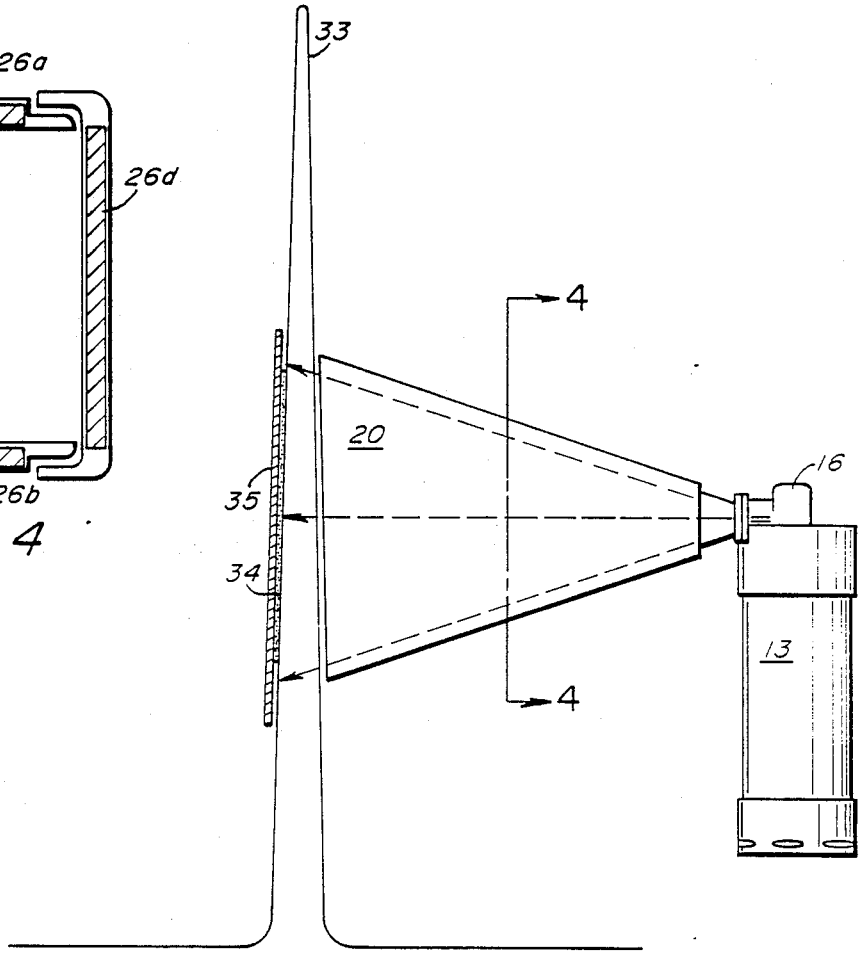
FIG. 3, is an exploded perspective view of a portion of the invention.

With the tubehead shield 16 attached to the generator tank 13 the source of X-rays is generally shielded to limit the emitted X-rays from the generator 13. The collimator cone 20 serves to direct and shield X-rays eminating from the generator 13 towards the target. As described in more detail below the collimator cone 20 may be formed as a single piece, as shown at FIG. 3, or may be formed of a modular construction, as shown at FIG. 2, where in the upper cone support portion 25 and lower cone support 27 are joined by connecting panels that are detachably secured to upper and lower support portions 25 and 27. Where the cone is of a generally larger size modular construction is likely to be more suitable. Where the cone is smaller the integral construction is more likely to be suitable. The embodiment shown at FIGS. 2 and 5 illustrate modular construction, whereas the embodiment shown at FIG. 3 illustrates the unitary construction of the cone 20. As presently anticipated the unitary construction cone may be formed to be approximately 15.4 cm.×15.4 cm. (6"×6"). In one embodiment of the modular cone it is formed to be 35.56 cm. by 43.18 cm. (14"×17"). It is to be understood, however, that various sizes of each type of cone construction may be implemented within the scope of the present invention.

FIG. 5 illustrates the upper support portion 25 of cone 20 as it is connected to the tubehead 16. As shown therein portion 25 connects to the tubehead 16 via clamp 23 which, though shown as a clamp, may be substituted by any of a variety of different clamping means adapted to securely engage the portion 25 to the tubehead 16. It is to be understood that where the cone is of integral construction the means for connecting to the tubehead 16 may be identical as that shown in FIGS. 2 and 5, or may use equivalent means, as described above.

In order to minimize the weight of the apparatus 11, the upper cone support portion 25 and lower cone support portion 27 may be formed of lightweight composite materials such as graphite, epoxy, or plastics. Four outer panels 26*a*, 26*b*, 26*c* and 26*d* are preferably formed of lead or lead covered materials and may be connected to upper support portion 25 and lower support portion 27 by means of fasteners 28, 29, or by any other conventional means.

Holding fixture 21 extends between the generator tank 13 and the cone 20. The holding fixture 21 provides mechanical support for the apparatus 11 and may be formed to engage an adjustable tripod of conventional design. The tripod connection permits the apparatus 11 to be adjusted in orientation with respect to azimuth and elevation. The tripod further provides firm footing and support for the apparatus 11.

The flaps 31 and 32 connect to the cone 20 and provide additional shielding to guard against radiation emitted from about the perimeter of cone 20. The flaps 31 and 32 are preferably formed of lead or lead coated material and may be disposed about and connected to cone 20 in any convenient fashion. Where cone 20 is formed as an integral unit the flaps 31 and 32 may be permanently secured to the cone 20. Where the cone is of a modular construction the flaps 31 and 32 may be independently secured to the outer surface of the panels forming the outer surface of cone 20.

FIG. 3 illustrates the use of one embodiment of the present invention to expose a film to X-ray a portion of structure 33. As shown therein film 34 is held against the back of surface 33 and covered by means of backup lead shield 35. Thus, structure 33 may be X-rayed.

The backbone panel 26, of a generally triangle shape is secured against the outer face of the upper cone support portion 25, by means of two panel bolts or panel fasteners 28, and to the base 22, of the holding fixture 21. Once the backbone panel 26*a*, is connected to the upper cone support portion 25, the holding fixture 21, is rotated to uppermost required elevation and azimuth. The lower support portion 27 is then secured against the inner side of the side wall panel 26*a* by the means of two conventional panel bolts 29.

Figure 4:
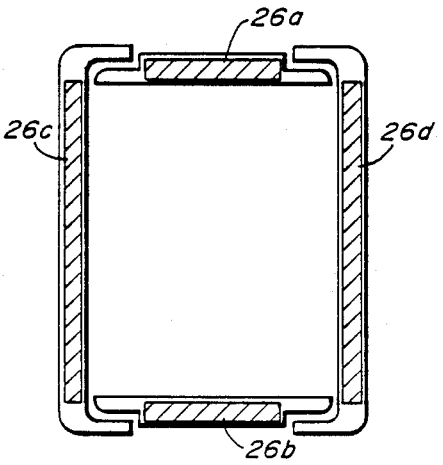
FIG. 4, is a side elevational view of the present invention in actual use.

Another opposite panel 26*b*, which is substantially identical to the backbone panel 26*a*, (FIG. 4), is then secured against the outer face of the upper support portion 25, and the inner face of the lower support portion 27. It should be noted that the base 22, of the holding fixture 21, attaches to the backbone panel 26*a*. The remaining outer panels 26*c* and 26*d* are identicially dimensioned and generally shaped in a triangular or trapezoidal form. These panels 26*c* and 26*d* are attached to the outer faces of the upper support portion 25 and lower support portion 27. By means such as fastener 30 the outer panels 26*c* and 26*d* also partially overlap the outer faces of the backbone panel 26*a* and the opposite panel 26*b*. As shown in FIG. 4, the overlapping and interlocking of the four panels 26*a*, 26*b*, 26*c*, and 26*d* provides for a maximum containment of the radiation within the collimator cone 20.

The backbone panel 26*a* and opposite panel 26*b* have identicial dimensions, and the other outer panel 26*c* and 26*d* have identicial dimensions larger than those of the backbone and opposite panels 26*a* and 26*b*. For this reason, lead flaps 31 and 32, are provided to interface between the collimator cone 20 and the object to be X-rayed, and to eliminate stray radiation. FIG. 2 further illustrates the interlocking and interposition of the flaps 31 and 32. The smaller flap 31, overlaps with and is stacked upon the larger flap 32, to provide additional precautionary shielding.

While particular embodiment of the present invention have been disclosed, it is to be understood that various different modifications are possible and are contemplated in the true spirit and scope of the appended claims. There is no intention, therefore, of limitation to the exact abstract or disclosure herein presented.

What is claimed is:

1. A transportable shielding apparatus suitable for on-site assembly and use with an X-ray generator comprising:

a shielded cone connectable to the X-ray generator and extending therefrom towards an object to be X-rayed located external to the cone, said cone comprising an upper cone support portion detachably connected to the X-ray generator, a lower cone support portion forming the base of the cone and a plurality of trapezoidal panels detachably connected to and extending between said upper and lower cone support portions said panels having interlocking edge portions extending along the length thereof.

2. The apparatus as recited in claim 1 further comprising a shroud removably fitted to and extending about the X-ray generator.

3. The apparatus as recited in claim 2 further comprising a shielding cap covering a first end portions of the X-ray generator.

4. The apparatus as recited in claim 3 further comprising a tubehead shield detachably connected to the X-ray generator about an output port of the X-ray generator.

5. The apparatus as recited in claim 4 wherein said tubehead shield is connected to said upper cone support portion.

6. The assembly as recited in claim 5 wherein said shielding cap, shroud, tubehead shield, and cone cooperate to encapsulate the X-ray generator and X-rays emitted therefrom.

7. The apparatus as recited in claim 6 further comprising a holding fixture connected between said generator and said cone.

8. The apparatus as recited in the claim 7 wherein said holding fixture is connectable to a tripod.

9. The apparatus as recited in claim 1 wherein said upper and lower cone support portions each comprise a frame member having a truncated pyramid construction said first and second frame members being paced from each other and joined by the panels.

10. The transportable shielding apparatus as recited in claim 9 wherein said upper and lower cone support portions each comprise an outer surface and an inner surface, and wherein said panels are disposed adjacent the outer surface of the upper cone support portion and adjacent the inner surface of the lower cone support portion.

11. The apparatus as recited in claim 1 wherein said panels are joined solely by connection to said upper and lower cone support portions and along said panel edge portions.

12. A transportable collimator and shielding apparatus suitable for on-site assembly used to shield emitted rays comprising:

a shielded cone connectable to an output port of a radiation source and extending towards an object to be X-rayed located external to the cone, said cone comprising an upper cone support portion, a lower cone support portion, and a plurality of interlocking panels extending between said upper and lower cone support portions to form a hollow body, said panels having interlocking edge portions extending along the length thereof;

a first shielding means covering the radiation source; and a second shielding means covering the port and simultaneously tightly engaging the radiation source.

13. The apparatus as recited in claim 12, wherein the first shielding means comprises a shroud snugly and removably fitting said radiation source.

14. The apparatus as recited in claim 10, wherein said second shielding means detachably covers the output port and a portion of the radiation source.

15. The apparatus as recited in claim 14, wherein said second shielding means is formed of aluminum lined with lead.

16. The apparatus as recited in claim 14, wherein said second shielding means detachably engages said cone.

17. The apparatus as recited in claim 16, wherein said collimator cone comprises:

an upper cone support portion attached to the second shielding means;

a lower cone support portion; and a plurality of interlocking panels forming a hollow body, said panels having interlocking edge portions along the length thereof, said panels being detachably connected to the upper cone support portion and lower cone support portion.

18. The apparatus as recited in claim 10 wherein said interlocking panels comprises a back bone panel, an opposite panel, and two outer panels, each of said panels having a generally trapezoidal shape.

19. The apparatus as recited on claim 18 further comprising means for interfacing the collimator cone to a structure to be X-rayed, said interfacing means including a plurality of overlapping flaps detachably engaged to the panels and extending perpendicular therefrom.

20. The apparatus as recited in claim 17 further comprising a holding fixture tightly secured to the source of radiation and to said collimating means.

* * * * *

UNITED STATES PATENT AND TRADEMARK OFFICE

CERTIFICATE OF CORRECTION

PATENT NO. : 4,852,141

DATED : July 25, 1989

INVENTOR(S) : Michael Horn

It is certified that error appears in the above-identified patent and that said Letters Patent is hereby corrected as shown below:

Column 1, line 9, delete --device--
Column 1, line 10, after shielding, add device
Column 3, line 56, after lined, delete --,--
Column 3, line 63, after tubehead, add dome
Column 4, line 10, after support, add portion
Column 5, line 67, after end, delete --portions--, add portion
Column 6, line 20, after being, delete --paced--, add spaced
Column 6, line 21, after joined, add only
Column 7, line 4, delete --comprises--, add comprise
Column 7, line 7, after recited, delete --on--, add in

Signed and Sealed this

Twenty-second Day of May, 1990

*Attest:*

*Attesting Officer*

HARRY F. MANBECK, JR.

*Commissioner of Patents and Trademarks*